US006661989B2

(12) United States Patent
Pitts et al.

(10) Patent No.: US 6,661,989 B2
(45) Date of Patent: Dec. 9, 2003

(54) XEROGRAPHIC FUSING APPARATUS WITH INPUT SHEET GUIDE

(75) Inventors: Ian Pitts, Bassingbourn (GB); Stan Alan Spencer, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/119,430

(22) Filed: Apr. 9, 2002

(65) Prior Publication Data

US 2003/0190175 A1 Oct. 9, 2003

(51) Int. Cl.[7] ..... G03G 15/20
(52) U.S. Cl. ..... 399/322; 399/400
(58) Field of Search ..... 399/316, 317, 399/322, 323, 397, 400

(56) References Cited

U.S. PATENT DOCUMENTS 4,876,576 A * 10/1989 Itaya et al. ..... 399/322
5,771,434 A * 6/1998 Hokari ..... 399/400
5,822,668 A 10/1998 Fromm et al. ..... 399/323

* cited by examiner

*Primary Examiner*—William J. Royer
(74) *Attorney, Agent, or Firm*—R. Hutter

(57) ABSTRACT

In a fusing apparatus, such as used in xerography, two rolls form a nip therebetween. A guide member is positionable to direct a sheet approaching the nip to enter the nip at an angle so that an arc or buckle is created in the sheet between a marking station and the nip. The arc or buckle is helpful in avoiding the transfer of mechanical energy from the fusing apparatus to the marking station. As the trailing edge of the sheet exits the marking station, the guide member is positioned to straighten the sheet.

12 Claims, 4 Drawing Sheets

XEROGRAPHIC FUSING APPARATUS WITH INPUT SHEET GUIDE

TECHNICAL FIELD

The present invention relates to a fusing apparatus, such as used in electrostatographic printing.

BACKGROUND

In electrostatographic printing, commonly known as xerographic or printing or copying, an important process step is known as "fusing." In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable, non-smudging images are rendered on the substrates.

Currently, the most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image.

One practical problem with certain compact designs of xerographic or other printers relates to the unintended transfer of mechanical energy, such as vibration or a torque transient, originating at the fusing apparatus and traveling through a print sheet while another portion of the print sheet is still receiving marking material (e.g., toner or ink) at a marking station. This vibration or other mechanical energy can cause a print defect such as smearing at the marking station.

DESCRIPTION OF THE PRIOR ART

U.S. Pat. No. 5,822,668 describes a general configuration of a fuser module as used in a xerographic printer.

SUMMARY OF THE INVENTION

According to one aspect of the present invention, there is provided a method of conveying a sheet from a marking station to a nip formed by a first roll and a second roll. A leading edge of the sheet is directed toward the nip at an angle which causes the sheet to form an arc between the marking station and the nip as the leading edge of the sheet enters the nip. As a trailing edge of the sheet substantially exits the marking station, the sheet is straightened between the marking station and the nip.

According to another aspect of the present invention, there is provided a printing apparatus, comprising a marking station; a nip, formed by a first roll and a second roll; means for directing a leading edge of the sheet toward the nip at an angle which causes the sheet to form an arc between the marking station and the nip as the leading edge of the sheet enters the nip; and means for straightening the sheet between the marking station and the nip as a trailing edge of the sheet substantially exits the marking station.

According to another aspect of the present invention, there is provided a fusing apparatus for printing, comprising a first roll and a second roll, forming a nip therebetween; and a guide member, the guide member being positionable to direct a leading edge of a sheet toward the nip at an angle which causes the sheet to form an arc as the leading edge of the sheet enters the nip.

One practical problem with certain compact designs of xerographic or other printers relates to the unintended transfer of mechanical energy, such as vibration or a torque transient, originating at the fusing apparatus and traveling through a print sheet while another portion of the print sheet is still receiving marking material (e.g., toner or ink) at a marking station. This vibration or other mechanical energy can cause a print defect such as smearing at the marking station.

DETAILED DESCRIPTION

Figure 1:
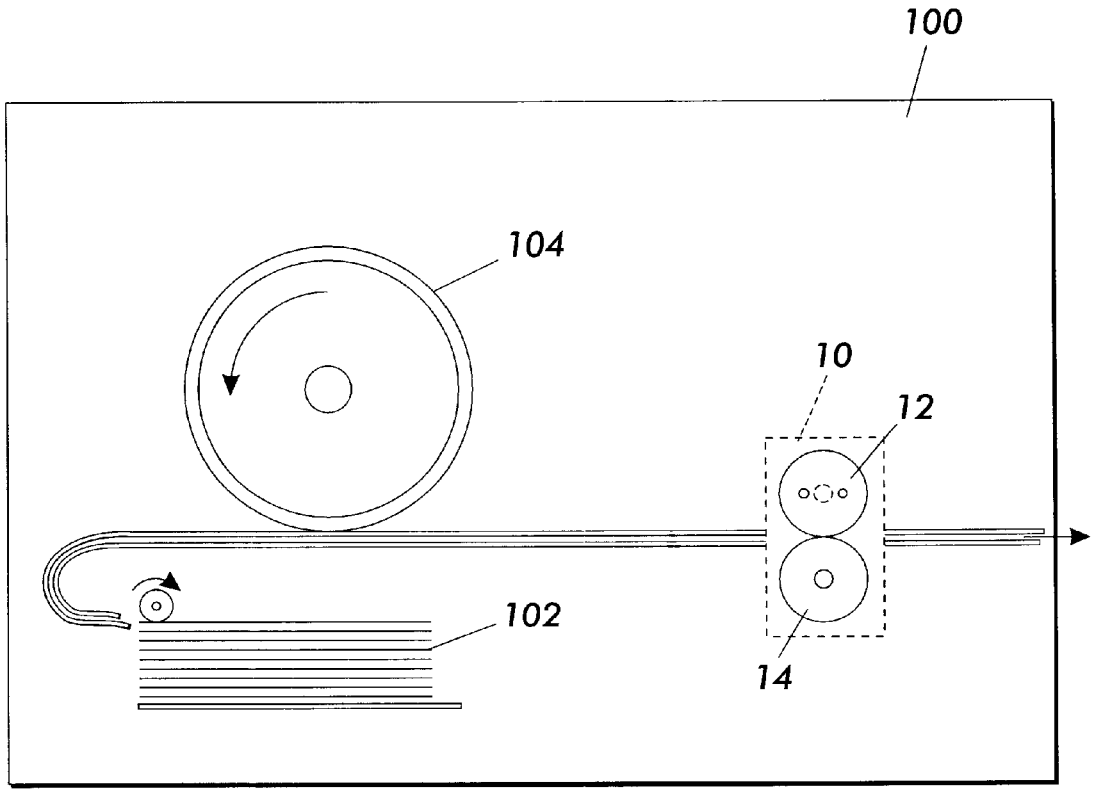
FIG. 1 PRIOR ART
FIG. 1 is a simplified elevational view showing the essential portions of an electrostatographic printer, such as a xerographic printer or copier, relevant to the present invention.

FIG. 1 is a simplified elevational view showing the essential portions of an electrostatographic printer, such as a xerographic printer or copier, relevant to the present invention. A printing apparatus 100, which can be in the form of a digital or analog copier, "laser printer," ionographic printer, or other device, includes mechanisms which draw substrates S, such as sheets of paper, from a stack 102 and cause each sheet to obtain a toner image from the surface of a charge receptor 104. The toner image is transferred from the charge receptor 104 to the sheet by a transfer corotron 106, and the sheet is detached from the surface of the charge receptor 104 by a detack corotron 108. Once a particular sheet obtains marking material from charge receptor 104, the sheet is caused to pass through a fusing apparatus such as generally indicated as 10. (Although a charge receptor 104, as would be used in an electrostatographic printer, is shown, other types of "marking station," such as including an ink-jet printhead and/or an intermediate transfer member, can be contemplated in conjunction with the claimed invention.) Depending on a particular design of a printing apparatus, fusing apparatus 10 according to the invention may be in the form of a fuser module which can be readily removed and installed, in modular fashion, from the larger apparatus 100.

A typical design of the fusing apparatus 10 includes a fuser roll 12 and a pressure roll 14. Fuser roll 12 and pressure roll 14 cooperate to exert pressure against each other across a nip formed therebetween. When a sheet passes through the nip, the pressure of the fuser roll 12 against the pressure roll 14 contributes to the fusing of the image on a sheet. Fuser roll 12 further includes means for heating the surface of the fuser roll 12, so that heat can be supplied to the sheet in addition to the pressure, further enhancing the fusing process. Typically, the fuser roll 12, having the heating means associated therewith, is the roll which contacts the side of the sheet having the image desired to be fused.

Generally, the most common means for generating the desired heat within the fuser roll 12 is one or more heating elements within the interior of fuser roll 12, so that heat generated by the heating elements will cause the outer surface of fuser roll 12 to reach a desired temperature. Basically, the heating elements can comprise any material which outputs a certain amount of heat in response to the application of electrical power thereto: such heat-generating materials are well known in the art.

As mentioned above, a practical problem with certain compact designs of xerographic or other printers relates to the unintended transfer of mechanical energy, such as vibration, originating at the fusing apparatus 10 and traveling through a print sheet while another portion of the print sheet is still receiving marking material (e.g., toner or ink) at the marking station such as charge receptor 104. This vibration or other mechanical energy can cause a print defect.

Figure 2:
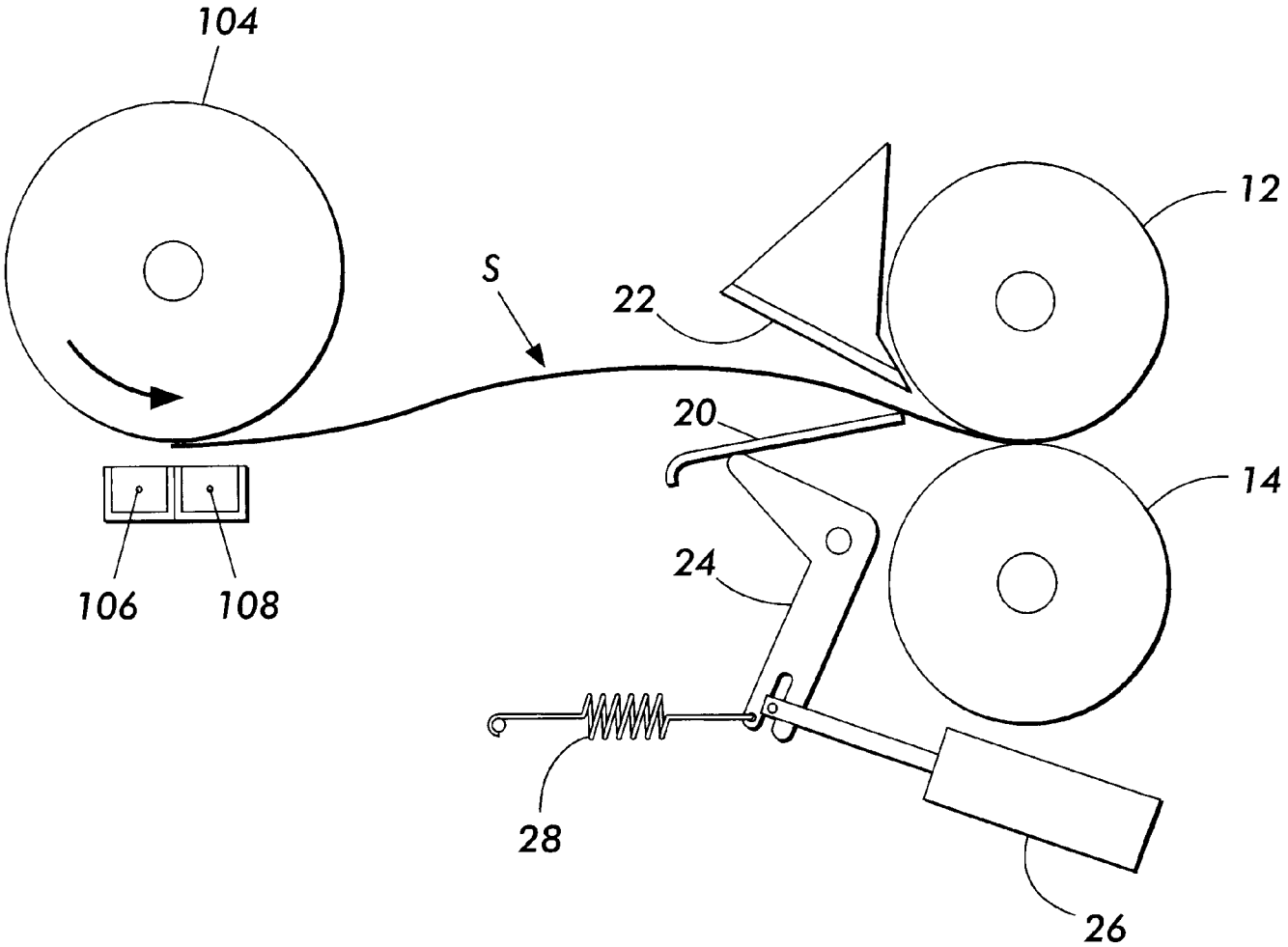
FIGS. 2 and 3 are elevational views of a print sheet passing from a charge receptor to a fusing apparatus.
Figure 3:
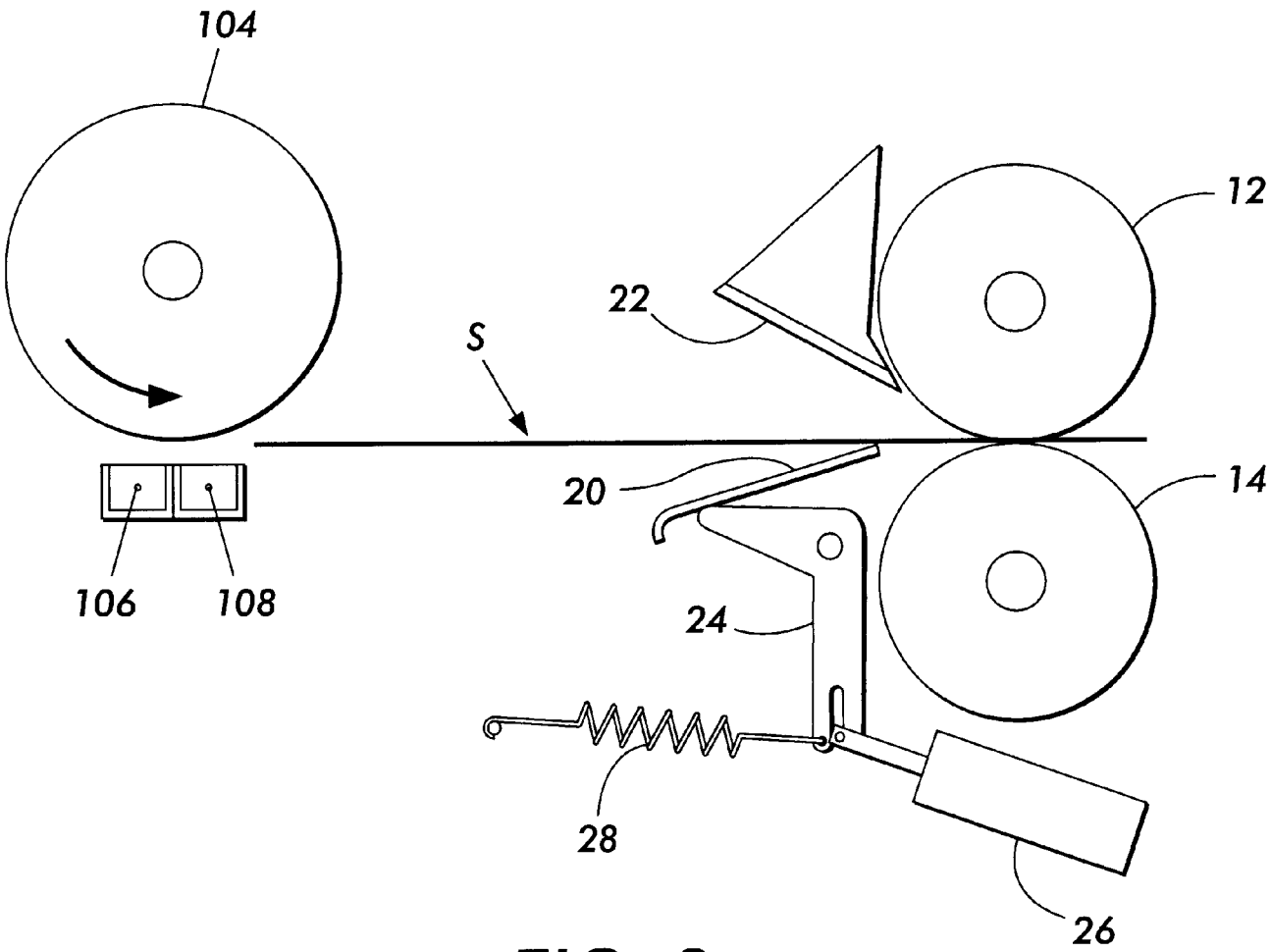

FIGS. 2 and 3 are elevational views of a print sheet S passing from a charge receptor 104 to a fusing apparatus 10 showing a method and apparatus which addresses the problem of transfer of mechanical energy through a print sheet S. In addition to the elements described above, there is provided, just upstream of the nip formed by rolls 12, 14, a movable guide member, or plate, 20, which extends substantially the length of the rolls 12, 14. Also adjacent the nip is an upper input guide 22. In this embodiment, guide plate 20 is operatively associated with a bell crank 24, which in turn is associated with a solenoid 26 and a tension spring 28. The solenoid 26, through the bell crank 24, operates to selectably position guide plate 20 relative to the nip. Solenoid 26 is controlled via a control system (not shown) which is coordinated with the overall operation of the printing apparatus.

With reference to FIG. 2, solenoid 26 is operated to position guide plate 20 so that a leading edge of the sheet S emerging from the charge receptor 104 (and still having a portion in contact with charge receptor 104) is directed toward the nip at an angle which causes the sheet to form an arc between the charge receptor 104 and the nip as the leading edge of the sheet S enters the nip.

While a sheet S is passing through a printing machine with a portion thereof near or in the nip and another portion thereof still in contact with charge receptor 104, it is possible that vibration or other mechanical energy from the fusing apparatus 10 can travel through the sheet S and cause a print defect for the portion of the sheet S still in contact with the marking station. More specifically, when the sheet S enters the fuser nip a large torque transient is imparted to the fuser nip and subsequent drive system. As a result of this sudden transient the whole system slows down momentarily, and the sheet S decelerates as well. If the sheet is straight from the fuser nip back to the transfer zone, this deceleration will be directly seen at transfer, causing a smear as the sheet S momentarily is moving backwards. If, as in FIG. 2, the sheet S is formed into an arc between the fuser nip and the transfer zone, then this deceleration simply pushes back on the arc, which momentarily makes it higher, but does not affect the image in the transfer zone. This buckle or arc thus serves to dampen the energy due to the torque transient.

The deliberate creation of an arc, or buckle, in sheet S between the marking station and the nip serves to lessen the ability for such a print defect to occur.

However, when an arc is created in sheet S, such as shown in FIG. 2, there may be a danger that, once the trailing edge of the sheet S clears the charge receptor 104 (broadly, when the sheet S substantially exits the marking station), the sheet may flick upward and contact the upper input guide 22. Thus, it is desirable to remove the arc once the sheet S has cleared the marking station.

FIG. 3 shows the elements of FIG. 2, after the sheet S has begun to travel through the nip and the trailing edge of the sheet S has cleared the charge receptor 104. Here, solenoid 26 is operated to position guide plate 20 so that the arc shown in FIG. 2 is straightened and the balance of sheet S is moved straight through the nip.

As part of a larger control system governing the entire printing apparatus, the control of the solenoid 26 or other device can be modified for optimal performance. For instance, once the guide plate 20 is positioned to create an arc in the sheet S (as in FIG. 2), the guide plate 20 can be withdrawn (toward the position in FIG. 3) to straighten the sheet S at any time during the passage of a sheet S through the system, e.g., at some predetermined time before the trailing edge of the sheet S is expected to exit the marking station; in response to the trailing edge being detected as passing a certain point in the sheet path; or in response to some detected physical condition such as a lack of vibration in the apparatus. Also, depending on a specific design, the motion of the guide plate 20 between the FIG. 2 and FIG. 3 positions can be, in various parts of a sheet-feeding cycle, relatively gradual or relatively abrupt.

Although the illustrated embodiment shows guide plate 20 being positionable via a solenoid 26, other electromechanical devices for effecting the positioning are readily contemplated, such as cam mounted on a rotating axle. If the fusing apparatus 10 is in the form of a module (such as fusing apparatus 10 in FIG. 1) which is readily removable and installable in a larger apparatus, the electromechanical device can be provided as part of the module, or the electromechanical device can be part of the larger apparatus.

Figure 4:
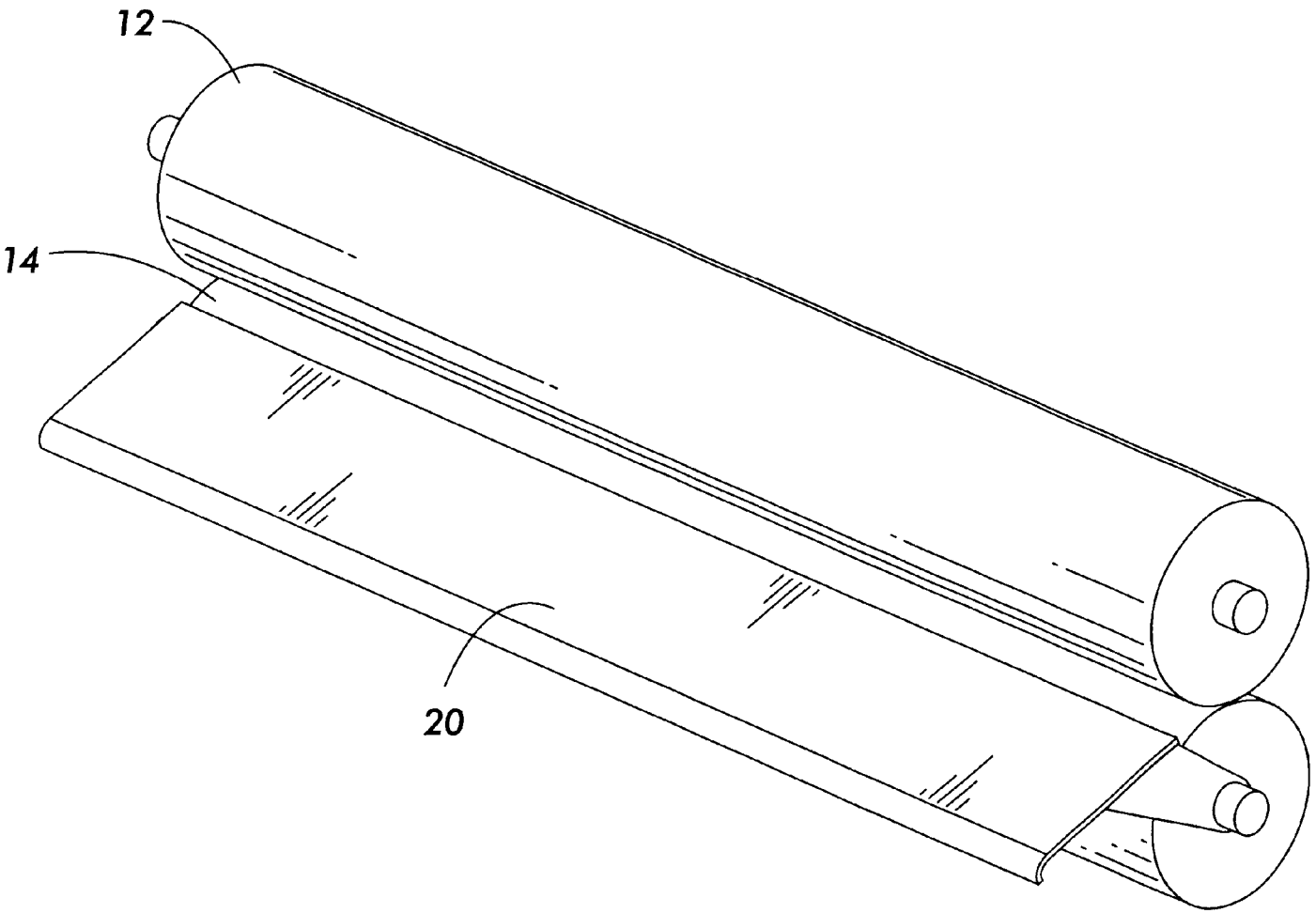
FIG. 4 is a perspective view showing, in isolation, fuser rolls and a pivotably mounted guide member.

FIG. 4 is a perspective view showing, in isolation, the rollers 12, 14 and a mounted guide plate 20. In this embodiment, the guide plate 20 is pivotably mounted coaxially with pressure roll 14. In alternate embodiments, the guide plate 20 can be pivotably mounted relative to some other axis, or can be slidably mounted. If the fusing apparatus 10 is in the form of a module (such as 10 in FIG. 1) which is readily removable and installable in a larger apparatus, the guide plate 20 can be provided as part of the module, or the guide plate 20 can be part of the larger apparatus.

What is claimed is:

1. In a printing apparatus, a method of conveying a sheet from a marking station to a nip formed by a first roll and a second roll, comprising:

directing a leading edge of the sheet toward the nip at an angle which causes the sheet to form an arc between the marking station and the nip as the leading edge of the sheet enters the nip; and as a trailing edge of the sheet substantially exits the marking station, straightening the sheet between the marking station and the nip.

2. The method of claim 1, the directing step including positioning a guide member near the nip.

3. The method of claim 2, the straightening step including withdrawing the guide member.

4. The method of claim 1, wherein the first roll and the second roll form a fusing apparatus.

5. The method of claim 1, wherein the marking station includes an image-bearing charge receptor.

6. A printing apparatus, comprising:

a marking station;

a nip, formed by a first roll and a second roll;

means for directing a leading edge of a sheet toward the nip at an angle which causes the sheet to form an arc between the marking station and the nip as the leading edge of the sheet enters the nip; and means for straightening the sheet between the marking station and the nip as a trailing edge of the sheet substantially exits the marking station.

7. The apparatus of claim 6, further comprising a guide member; and the directing means including means for positioning the guide member near the nip.

8. The apparatus of claim 7, the straightening means including means for withdrawing the guide member.

9. The apparatus of claim 7, wherein the guide member is pivotably mounted.

10. The apparatus of claim 9, wherein the guide member is pivotably mounted about an axis coaxial with the first roll.

11. The apparatus of claim 6, wherein the first roll and the second roll form a fusing apparatus.

12. The apparatus of claim 6, wherein the marking station includes an image-bearing charge receptor.

* * * * *